US011241613B1

(12) United States Patent
Lee

(10) Patent No.: US 11,241,613 B1
(45) Date of Patent: Feb. 8, 2022

(54) GEAR PRIZE WHEEL GAMING DEVICE AND METHOD

(71) Applicant: Andy Dao Quang Lee, Walnut, CA (US)

(72) Inventor: Andy Dao Quang Lee, Walnut, CA (US)

( * ) Notice: Subject to any disclaimer, the term of this patent is extended or adjusted under 35 U.S.C. 154(b) by 0 days.

(21) Appl. No.: 16/984,292

(22) Filed: Aug. 4, 2020

(51) Int. Cl.

| | |
|---|---|
| ***A63F 5/04*** | (2006.01) |
| ***A63F 5/00*** | (2006.01) |
| *A63F 3/00* | (2006.01) |
| *A63F 11/00* | (2006.01) |

(52) U.S. Cl.
CPC ..... *A63F 5/0094* (2013.01); *A63F 5/045* (2013.01); *A63F 5/0005* (2013.01); *A63F 5/04* (2013.01); *A63F 5/043* (2013.01); *A63F 2003/0029* (2013.01); *A63F 2003/00287* (2013.01); *A63F 2011/0016* (2013.01); *A63F 2011/0018* (2013.01)

(58) Field of Classification Search
CPC .. A63F 5/045; A63F 5/043; A63F 5/04; A63F 5/0005; A63F 2003/00287; A63F 2003/0029; A63F 2011/0016; A63F 2011/0018
USPC ..... 273/142 H, 142 HA, 142 R, 273/143 C–143 G, 143 J, 143 JA–143 JD
See application file for complete search history.

(56) References Cited

U.S. PATENT DOCUMENTS 3,172,666 A * 3/1965 Ryan ..... G09B 25/02 273/243
3,193,293 A * 7/1965 Schaper ..... A63F 3/00261 273/275
3,417,996 A * 12/1968 Janiszewski ..... A63F 9/0819 273/157 R
4,058,317 A * 11/1977 McCarthy ..... A63F 3/00697 273/242

(Continued)

FOREIGN PATENT DOCUMENTS

AU 2011265459 C1 1/2012
CN 107316408 A 11/2017

(Continued)

OTHER PUBLICATIONS

HABA Sensory Wall—Acrylic Gears Toy, 120394, http://www.littlepeoplescove.com/haba-sensory-wall-acrylic-gears-toy/.

(Continued)

*Primary Examiner* — Benjamin Layno
(74) *Attorney, Agent, or Firm* — Rumit Ranjit Kanakia

(57) ABSTRACT

The present disclosure provides a gaming device. The gaming device may include a geared-wheel assembly having a first gear wheel and a second gear wheel. The first gear wheel and the second gear wheel may be capable of getting rotatably engaged with each other via its teeth and slots. The gaming device may include a gear turntable member that may be aligned behind the first gear wheel and the second gear wheel. The gear turntable member may be rotatingly coupled to the first gear wheel and the second gear wheel. The gaming device may include a first front supporting (Continued)

member and a second front supporting member to support its respective gear wheel from front. The gaming device further includes a method of playing the gaming device, which defines a winning position or a losing position.

18 Claims, 4 Drawing Sheets

(56) References Cited

U.S. PATENT DOCUMENTS

| | | | | |
|---|---|---|---|---|
| 5,184,821 | A * | 2/1993 | Korenek | A63F 5/04 273/138.2 |
| 7,021,624 | B2 | 4/2006 | Luciano et al. | |
| 9,990,802 | B2 | 6/2018 | Rodgers et al. | |

FOREIGN PATENT DOCUMENTS

| | | | |
|---|---|---|---|
| DE | 19748194 | A1 | 5/1999 |
| JP | 2011103948 | A | 6/2011 |
| JP | 05999832 | B2 | 10/2013 |

OTHER PUBLICATIONS

HABA Grow.upp Gears Wheels Activity Wall Toy, 121103, http://www.littlepeoplescove.com/haba-grow-upp-gears-wheels-activity-wall-toy/.

* cited by examiner

GEAR PRIZE WHEEL GAMING DEVICE AND METHOD

FIELD OF THE DISCLOSURE

The present disclosure relates to gaming industries, and, more particularly, to a gaming device and method for playing.

BACKGROUND OF THE DISCLOSURE

In this technologically running world, gaming is the medium to relax and have fun with people. Nowadays gaming involves a lot of influence from science and has been a field of constant innovation. In order to indulge in gaming, users usually require interesting gaming devices to play. More often than not, the user especially uses gaming device which may exhibit characteristics like simple rules, fun factor, requires less or no skill, and so forth.

Whenever the user has to choose a gaming device, he/she is left over with a lot of conventional gaming device in the market. These conventional gaming devices may be effective in meeting various requirements but may not be able to address some of the specific problems. For example, there may be a conventional gaming device which may include complex rules in the game. As a result, the user may not be able to understand the gaming device and lose interest at the start.

Further, there may be a conventional gaming device which may require mental instincts to play the game. As a result, the user may not want to play the game for mental exercise and just want to relax and have fun.

Furthermore, there may be a conventional gaming device which may require a particular skill to play that particular game. As a result, most of the user may not want to play the game since he/she may not possess that particular skill.

Accordingly, there exists a need to overcome shortcomings of the existing conventional gaming devices. For example, there exists a need of a gaming device which may not include complex rules to play the game. Further, there is need of such gaming device which may not require mental instincts to play the game. Further, there is need of gaming device which may not require any particular skill to play the game.

SUMMARY OF THE DISCLOSURE

In view of the foregoing disadvantages inherent in the prior art, the general purpose of the present disclosure is to provide a gaming device, to include all advantages of the prior art, and to overcome the drawbacks inherent in the prior art.

Therefore, an object of the present disclosure is to provide a gaming device that exhibits simple rules to play the game.

Another object of the present disclosure is to provide such a gaming device that exhibits easy mental instincts to play the game.

Yet another object of the present disclosure is to develop such gaming device that require little or no skill to play the game.

In light of the above objects, in one aspect, a gaming device for playing games is provided. The gaming device may include a geared-wheel assembly. The geared-wheel assembly may include a first gear wheel and a second gear wheel rotatably engaged with each other. Further, the first gear wheel may be rotatable along a first axis of rotation, and a second gear wheel may be rotatable along a second axis of rotation. Furthermore, the first gear wheel may include a first plurality of teeth and a first plurality of slots. Each tooth and slot of the respective first plurality of teeth and first plurality of slots may be alternatively aligned across a circumferential edge of the first gear wheel. Further, each alternate tooth of the first plurality of teeth may include a first card pin coupled to the tooth. Moreover, the second gear wheel may include a second plurality of teeth and a second plurality of slots. each tooth and slot of the respective second plurality of teeth and second plurality of slots may be alternatively aligned across a circumferential edge of the second gear wheel. Further, each alternate tooth of the second plurality of teeth may include a second card pin coupled to the tooth. The first gear wheel and the second gear wheel are rotatable along the respective first axis of rotation and second axis of rotation to define a winning position and a losing position. In the winning position, the first card pin and the second card pin of the respective tooth of the first and second plurality of teeth may be aligned adjacent to each other. In the losing position, the first card pin and the second card pin of the respective tooth of the first and second plurality of teeth may not be aligned adjacent to each other.

In one example form, the first gear wheel may be bigger in size than the second gear wheel and are aligned along the same plain adjacent to each other.

In one example form, the first axis of rotation may be parallel to the second axis of rotation.

In one example embodiment, the first gear wheel 110 and the second gear wheel 120 may include colour codes.

In one example embodiment, the first gear wheel comprises may include colour codes on alternating tooth of the plurality of teeth.

In one example embodiment, the second gear wheel may include same colour codes on each tooth of the plurality of teeth.

In one embodiment, the gaming device may further include a gear turntable member aligned behind the first gear wheel and the second gear wheel to rotatingly couple the first gear wheel and the second gear wheel along the respective first axis of rotation and second axis of rotation. In one example form, the gear turntable member may include a structure of a gear wheel type having teeth and slots.

In one embodiment, the gaming device may further include a first coupling arrangement and a second coupling arrangement. The first coupling arrangement may rotatingly couple the first gear wheel with the gear turntable member along the first axis of rotation in spaced manner from each other. Further, the second coupling arrangement may rotatingly couple the second gear wheel with the gear turntable member along the second axis of rotation in spaced manner from each other. The first and second coupling arrangements may include a screw, gasket and a gear gasket assembly.

In one embodiment, the gaming device may further include a first front supporting member and a second front supporting member. The first front supporting member may be placed in front and coupled to the first gear wheel along the first axis of rotation 110*a*, and the second front supporting member may be placed in front and coupled to the second gear wheel along the second axis of rotation.

In one embodiment, the first front supporting member may include a magnetic back to be magnetically coupled with a metallic frame structure provided on the first gear wheel. In one embodiment, the second front supporting member may include a magnetic back to be magnetically coupled with a metallic frame structure provided on the second gear wheel.

In one embodiment, the first front supporting member and the second front supporting member, each includes a structure of a gear wheel type having teeth and slots.

In one example embodiment, the first front supporting member is bigger in size than the second front supporting member.

In one example embodiment, the gaming device further includes a support stand having a base and a stand extending perpendicularly from the base. The stand may be coupled to the gear turntable member along at least one position.

In one example embodiment, the stand may be coupled to the gear turntable member along at least one position by at least one coupler. In one example form, the at least one coupler may include a screw and a butterfly button.

A method of playing game using a gaming device having: a geared-wheel assembly having a first gear wheel and a second gear wheel rotatably engaged with each other, wherein the first gear wheel is rotatable along a first axis of rotation and a second gear wheel is rotatable along a second axis of rotation, the first gear wheel having a first plurality of teeth and a first plurality of slots, wherein each tooth and slot of the respective first plurality of teeth and first plurality of slots are alternatively aligned across a circumferential edge of the first gear wheel, each alternate tooth of the first plurality of teeth having a first card pin coupled to the tooth, the second gear wheel having a second plurality of teeth and a second plurality of slots, wherein each tooth and slot of the respective second plurality of teeth and second plurality of slots are alternatively aligned across a circumferential edge of the second gear wheel, each alternate tooth of the second plurality of teeth having a second card pin coupled to the tooth, the method comprising: rotating at least one of the first gear wheel and the second gear wheel along the respective first axis of rotation and second axis of rotation; defining a winning position, when the first card pin and the second card pin of the respective tooth of the first and second plurality of teeth are aligned adjacent to each other, or defining a losing position, when the first card pin and the second card pin of the respective tooth of the first and second plurality of teeth are not aligned adjacent to each other.

In one embodiment, in one game played, the game device selects only one position, either the winning position or the losing position.

In one embodiment, in one game played, one or more player plays the game for, either the winning position or the losing position.

This together with the other aspects of the present disclosure, along with the various features of novelty that characterize the present disclosure, is pointed out with particularity in the claims annexed hereto and forms a part of the present disclosure. For a better understanding of the present disclosure, its operating advantages, and the specified object attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description taken in conjunction with the accompanying drawings, in which.

Like reference numerals refer to like parts throughout the description of several views of the drawing.

DETAILED DESCRIPTION OF THE DISCLOSURE

Figure 1A:
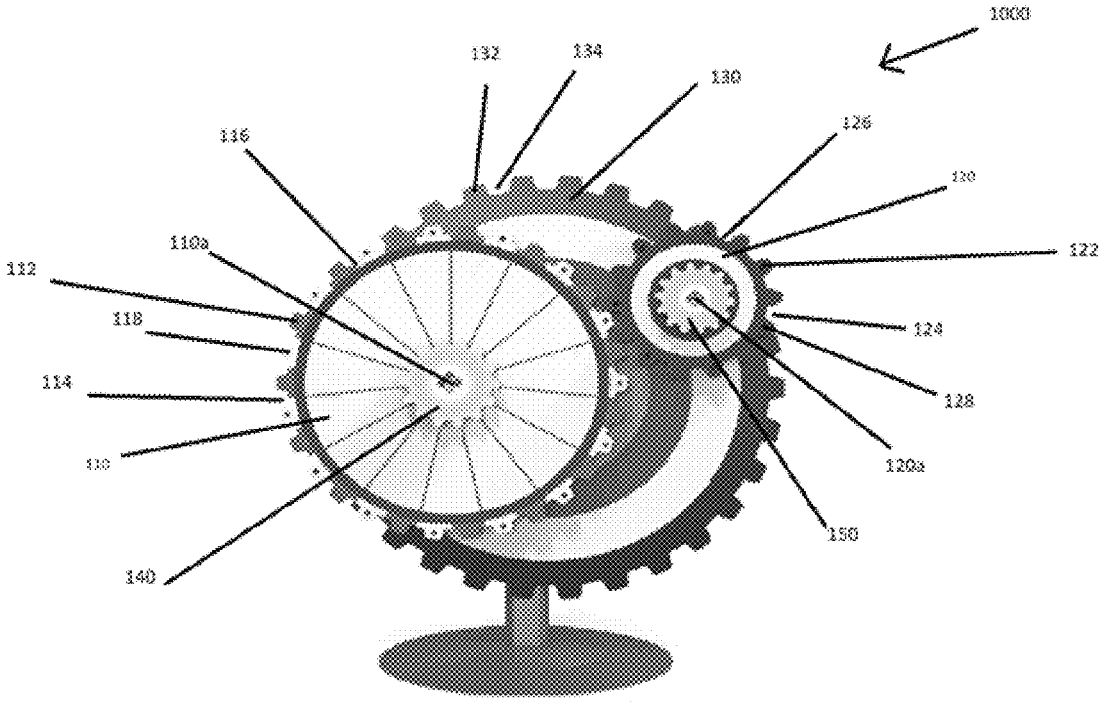
FIG. 1A illustrates a perspective view of a gaming device, in accordance with an exemplary embodiment of the present disclosure.

The exemplary embodiments described herein detail for illustrative purposes are subject to many variations in implementation. The present disclosure provides gaming device and method for playing. It should be emphasized, however, that the present disclosure is not limited to an antiviral and antibacterial textile material and method for preparing the same. It is understood that various omissions and substitutions of equivalents are contemplated as circumstances may suggest or render expedient, but these are intended to cover the application or implementation without departing from the spirit or scope of the present disclosure.

The terms "a" and "an" herein do not denote a limitation of quantity, but rather denote the presence of at least one of the referenced items.

The terms "having", "comprising", "including", and variations thereof signify the presence of a component.

The present disclosure provides a gaming device for playing games. The gaming device may include a geared-wheel assembly. The geared-wheel assembly may include a first gear wheel and a second gear wheel rotatably engaged with each other. Further, the first gear wheel may be rotatable along a first axis of rotation, and a second gear wheel may be rotatable along a second axis of rotation. Furthermore, the first gear wheel may include a first plurality of teeth and a first plurality of slots. Each tooth and slot of the respective first plurality of teeth and first plurality of slots may be alternatively aligned across a circumferential edge of the first gear wheel. Further, each alternate tooth of the first plurality of teeth may include a first card pin coupled to the tooth. Moreover, the second gear wheel may include a second plurality of teeth and a second plurality of slots. each tooth and slot of the respective second plurality of teeth and second plurality of slots may be alternatively aligned across a circumferential edge of the second gear wheel. Further, each alternate tooth of the second plurality of teeth may include a second card pin coupled to the tooth. The first gear wheel and the second gear wheel are rotatable along the respective first axis of rotation and second axis of rotation to define a winning position and a losing position. In the winning position, the first card pin and the second card pin of the respective tooth of the first and second plurality of teeth may be aligned adjacent to each other. In the losing position, the first card pin and the second card pin of the respective tooth of the first and second plurality of teeth may not be aligned adjacent to each other.

The gaming device will now be explained in conjunction with FIGS. 1A to 4 as below, in accordance with various exemplary embodiment of the present disclosure. Without departing from the scope of the present disclosure, the drawings as shown herein are only for better understanding of the disclosure and may not be in anyway considered to be limiting only to the diagrams as disclosed herein. There may be various other arrangements that may be covered by the claims of the present disclosure.

Figure 1B:
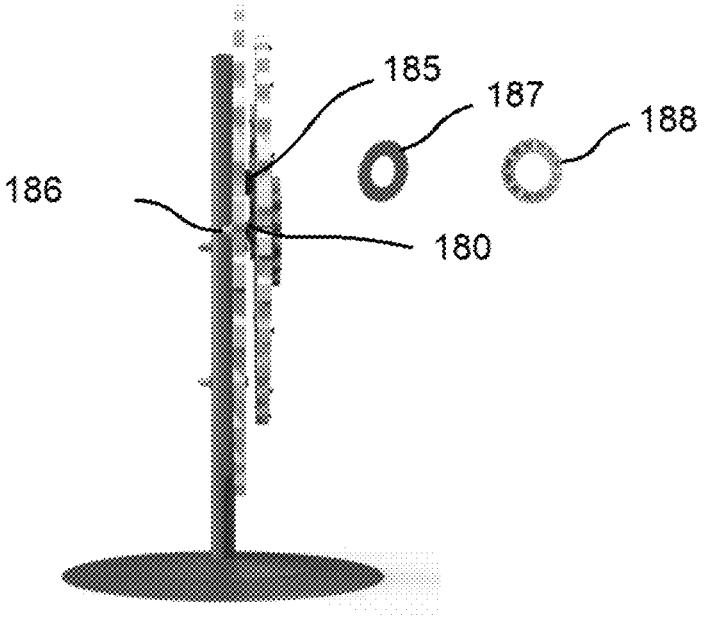
FIG. 1B illustrates a side view of a gaming device, in accordance with an exemplary embodiment of the present disclosure.
Figure 3:
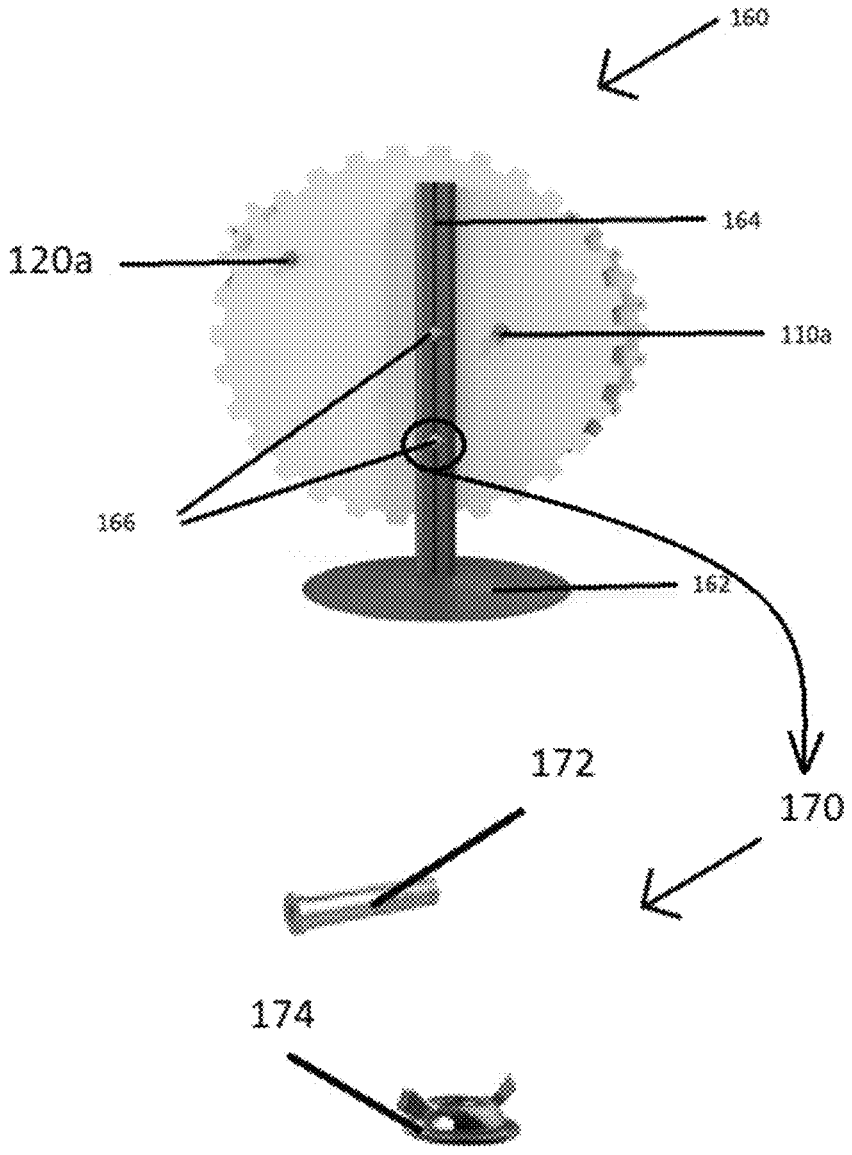
FIG. 3 illustrates a back view of a gaming device, in accordance with an exemplary embodiment of the present disclosure.

Referring now to FIGS. 1A and 1B, a perspective view and a side view of a gaming device 1000 are illustrated, respectively, in accordance with an exemplary embodiment of the present disclosure. The gaming device 1000 may include a geared-wheel assembly 100 having a first gear wheel 110 and a second gear wheel 120. The first gear wheel 110 and the second gear wheel 120 may be rotatably engaged with each other. The first gear wheel 110 may be rotatable along a first axis of rotation 110*a*, and the second gear wheel 120 may be rotatable along a second axis of rotation 120*a*. In one example arrangement, the first axis of rotation 110*a* may be parallel to the second axis of rotation 120*a* of the gaming device 1000, as also can be seen in FIG. 3.

The gaming device 1000 may further include a gear turntable member 130 that may be aligned behind the first gear wheel 110 and the second gear wheel 120. The first gear wheel 110 and the second gear wheel 120 may be rotatingly coupled to the gear turntable member 130 along the respective first axis of rotation 110*a* and second axis of rotation 120*a*. In one example form, the gear turntable member 130 may include a structure of a gear wheel type having teeth 132 and slots 134.

As shown in FIG. 1B, the gaming device 1000 may include a first coupling arrangement 180 and a second coupling arrangement 185. The first coupling arrangement 180 may be rotatingly coupled to the first gear wheel 110 with the gear turntable member 130 along the first axis of rotation 110*a* in a spaced manner from each other. Similarly, the second coupling arrangement 185 may be rotatingly coupled to the second gear wheel 120 with the gear turntable member 130 along the second axis of rotation 120*a* in a spaced manner from each other. In one example embodiment, the first and second coupling arrangements 180 and 185, respectively, may be a screw 186, gasket 187 and a gear gasket 188 assembly.

Further, as shown in FIG. 1A, the first gear wheel 110 of the gaming device 1000 may include a first plurality of teeth 112 and a first plurality of slots 114. Each tooth 112 and slot 114 of the respective first plurality of teeth 112 and the first plurality of slots 114 may be alternatively aligned across a circumferential edge 116 of the first gear wheel 110. Each alternate tooth 112 of the first plurality of teeth 112 may include a first card pin 118 coupled to the tooth 112. Similar to the first gear wheel 110, the second gear wheel 120 may have a second plurality of teeth 122 and a second plurality of slots 124. Each tooth 122 and slot 124 of the respective second plurality of teeth 122 and second plurality of slots 124 are alternatively aligned across a circumferential edge 126 of the second gear wheel 120. Each alternate tooth 122 of the second plurality of teeth 122 may include a second card pin 128 coupled to the tooth 122.

In one example embodiment, the first gear wheel 110 and the second gear wheel 120 of the gaming device 1000 may include color codes. The first gear wheel 110 may have different color codes on alternating tooth of the plurality of teeth 112. Contrary to the first gear wheel 110, the second gear wheel 120 may have same color codes on each tooth of the plurality of teeth 122. The color codes may be utilized for easy recognition of various positions of the teeth.

In one example arrangement, the first gear wheel 110 may be bigger in size than the second gear wheel 120 and may be aligned along the same plain adjacent to each other.

Further, as show in FIG. 1A, the gaming device 1000 may include a first front supporting member 140 and a second front supporting member 150. The first front supporting member 140 may be placed in front and coupled to the first gear wheel 110 along the first axis of rotation 110*a*. Similarly, the second front supporting member 150 may be placed in front and coupled to the second gear wheel 110 along the second axis of rotation 120*a*.

Figure 2A:
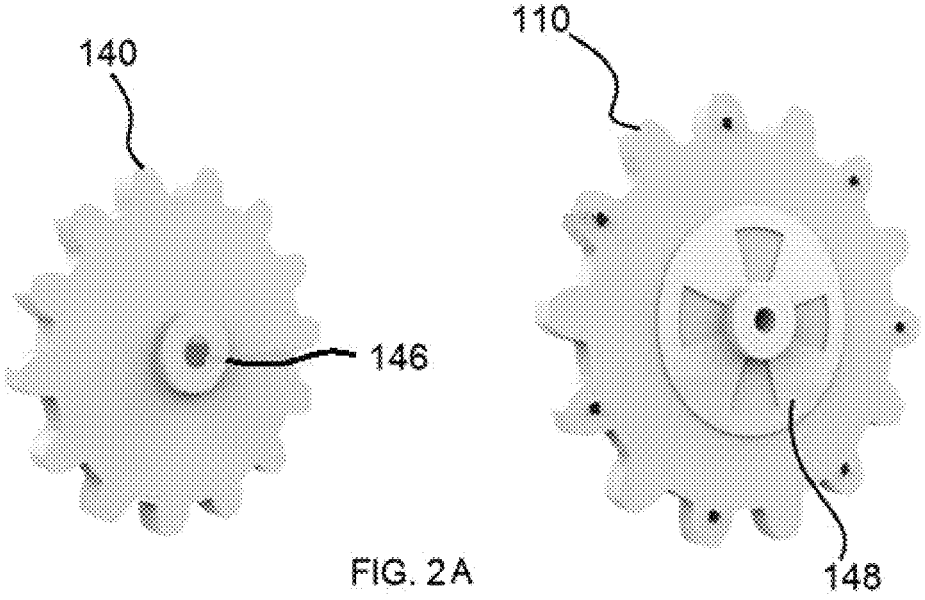
FIG. 2A illustrates exploded view of coupling arrangement of a first front supporting member and a first gear wheel of a gaming device, in accordance with an exemplary embodiment of the present disclosure.
Figure 2B:
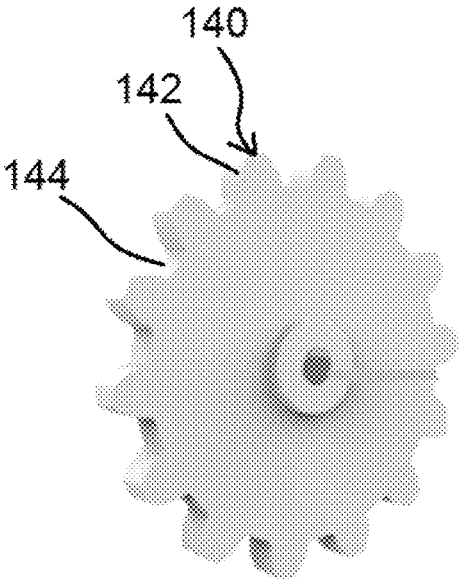
FIGS. 2B and 2C, respectively, illustrate a first front supporting member and a first front supporting member, in accordance with an exemplary embodiment of the present disclosure.
Figure 2C:
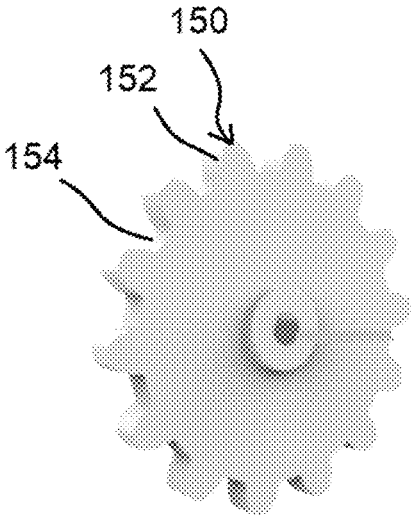

In one example arrangement, as shown in FIG. 2, the first front supporting member 140 may be placed in front and coupled to the first gear wheel 110 along the first axis of rotation 110*a* via a magnet-metal arrangement having a magnetic back 146 on the first front supporting member 140, and a metallic frame structure 148 on a front side of the first gear wheel 110. The magnetic back 146 may be magnetically coupled with the metallic frame structure 148 provided on the first gear wheel 110. As stated above in context of the first front supporting member 140, the second front supporting member 150 of the gaming device 1000 may also be coupled to the second gear wheel 120 by such a magnet-metal arrangement having a magnetic back on the second front supporting member 150 and a metallic frame structure on the second gear wheel 120.

In one example form, as shown in FIGS. 2A and 2B, the first front supporting member 140 and the second front supporting member 150 of the gaming device 1000 may include a structure of a gear wheel type having teeth 142, 152 and slots 144, 154.

In one example arrangement, the first front supporting member 140 may be bigger in size than the second front supporting member 150.

Referring now to FIG. 3, a back view of the gaming device 1000 is shown, in accordance with an exemplary embodiment of the present disclosure. FIG. 3 will now be described in conjunction with FIG. 1. As shown in FIG. 3, the gaming device 1000 may include a support stand 160 having a base 162 and a stand 164. The stand 164 may extend perpendicularly from the base 162. However, without departing from the scope of the present disclosure, the stand 164 may extend also taperedly or in any other orientation from the base 162. Further, the stand 164 may be coupled to the gear turntable member 130 along at least one position, as shown in FIG. 3, along two positions 166.

In one embodiment of the present disclosure, the stand 164 may be coupled to the gear turntable member 130 along the at least one position 166 by at least one coupler 170. In one embodiment of the present disclosure, the at least one coupler 170 may be a screw 172 and a butterfly button 174. However, without departing from the scope of the present disclosure the coupler may not be limited to a screw 172 and a butterfly button 174, and could be any other coupler.

In one embodiment, the gaming device 1000 including its five gear type components along with stand may be made of plastic, metal or wood.

Figure 4:
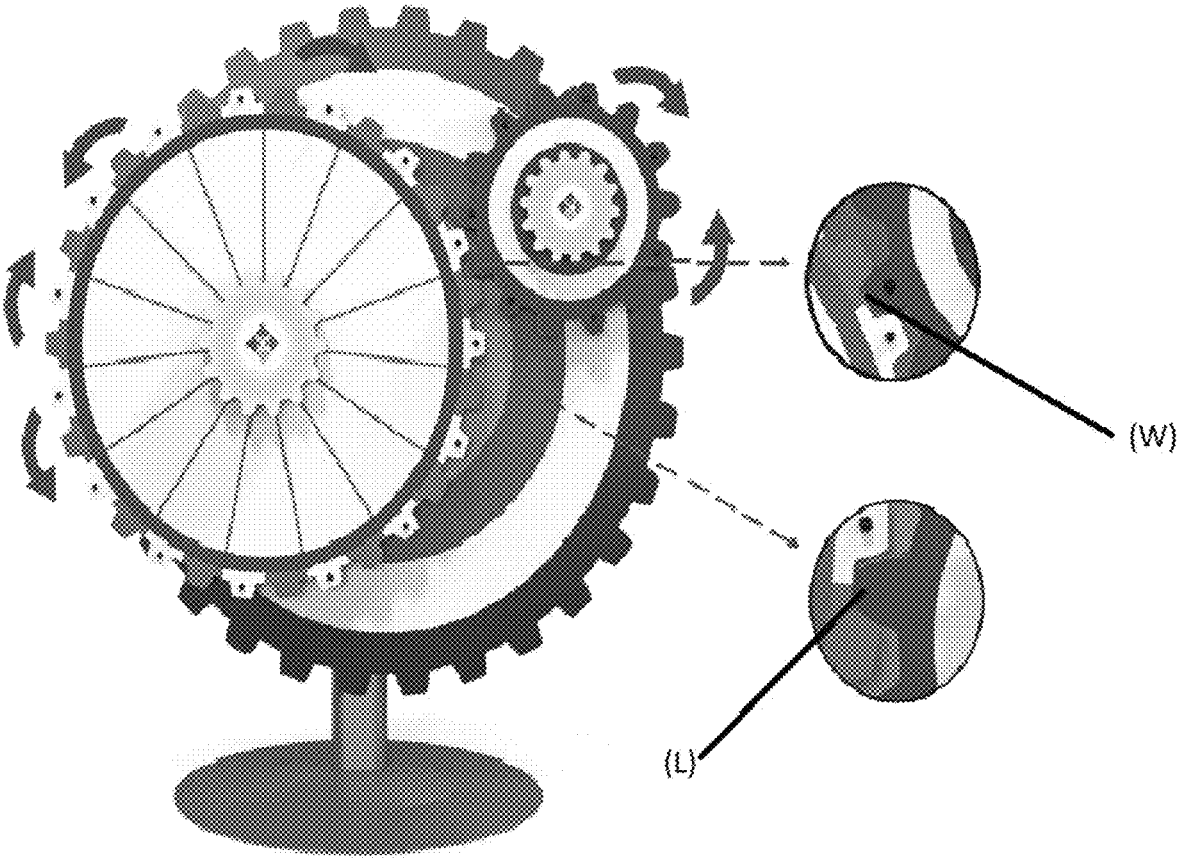
FIG. 4 illustrates a front view of a gaming device to show a winning position "W" and a losing position "L", in accordance with an exemplary embodiment of the present disclosure.

In one another aspect, a method for playing a game using a gaming device, such as the gaming device 1000, is provided. Herein in order to describe the method of playing game, reference for FIG. 4 will be taken along with FIGS. 1 to 3. The method includes rotating at least one of the first gear wheel 110 and the second gear wheel 120 in a counter clock wise direction, as indicated by arrows. The first gear wheel 110 and the second gear wheel 120 may rotate along the respective first axis of rotation 110*a* and second axis of rotation 120*a* to define a winner or a loser based on a winning position "W" or a losing position "L", as shown in FIG. 4.

In the winning position "W", the first card pin 118 and the second card pin 128 of the respective tooth 112, 122 of the first and second plurality of teeth 112, 122 are aligned adjacent to each other. In the losing position "L", the first card pin 118 and the second card pin 128 of the respective tooth 112, 122 of the first and second plurality of teeth 112, 122 may not aligned adjacent to each other.

In one game as played, the gaming device 1000 may select only one position, either the winning position "W" or the losing position "L". Furthermore, in one game played, one or more player may play the game for, either the winning position "W" or the losing position "L".

As presented, the present disclosure is advantageous in providing gaming device which may not include complex rules to play the game. Further, the present disclosure provides gaming device which may not require mental instincts to play the game. Furthermore, the present disclosure provides gaming device which may not require any particular skill to play the game.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present disclosure.

What is claimed is:

1. A gaming device for playing games, the gaming device comprising:

a geared-wheel assembly having a first gear wheel and a second gear wheel rotatably engaged with each other, wherein the first gear wheel is rotatable along a first axis of rotation and a second gear wheel is rotatable along a second axis of rotation, the first gear wheel having a first plurality of teeth and a first plurality of slots, wherein each tooth and slot of the respective first plurality of teeth and first plurality of slots are alternatively aligned across a circumferential edge of the first gear wheel, each alternate tooth of the first plurality of teeth having a first card pin coupled to the tooth, the second gear wheel having a second plurality of teeth and a second plurality of slots, wherein each tooth and slot of the respective second plurality of teeth and second plurality of slots are alternatively aligned across a circumferential edge of the second gear wheel, each alternate tooth of the second plurality of teeth having a second card pin coupled to the tooth;

a gear turntable member aligned behind the first gear wheel and the second gear wheel to rotatingly couple the first gear wheel and the second gear wheel along the respective first axis of rotation and second axis of rotation;

a first coupling arrangement to rotatingly couples the first gear wheel with the gear turntable member along the first axis of rotation in spaced manner from each other;

a second coupling arrangement to rotatingly couple the second gear wheel with the gear turntable member along the second axis of rotation in spaced manner from each other;

a first front supporting member placed in front and coupled to the first gear wheel along the first axis of rotation, and a second front supporting member placed in front and coupled to the second gear wheel along the second axis of rotation, wherein the first gear wheel and the second gear wheel are rotatable, respectively, via the first coupling arrangement and the second coupling arrangement, along the respective first axis of rotation and second axis of rotation to define a winning position and a losing position, wherein in the winning position, the first card pin and the second card pin of the respective tooth of the first and second plurality of teeth aligned adjacent to each other, and wherein in the losing position, the first card pin and the second card pin of the respective tooth of the first and second plurality of teeth not aligned adjacent to each other.

2. The gaming device of claim 1, wherein the first and second coupling arrangements comprise a screw, gasket and a gear gasket assembly.

3. The gaming device of claim 1, wherein the gear turntable member comprises a structure of a gear wheel type having teeth and slots.

4. The gaming device of claim 1, wherein the first gear wheel is bigger in size than the second gear wheel and are aligned along the same plain adjacent to each other.

5. The gaming device of claim 1, wherein the first axis of rotation is parallel to the second axis of rotation.

6. The gaming device of claim 1, wherein:

the first front supporting member comprises a magnetic back to be magnetically coupled with a metallic frame structure provided on the first gear wheel.

7. The gaming device of claim 1, wherein:

the second front supporting member comprises a magnetic back to be magnetically coupled with a metallic frame structure provided on the second gear wheel.

8. The gaming device of claim 1, wherein:

the first front supporting member and the second front supporting member, each comprises a structure of a gear wheel type having teeth and slots.

9. The gaming device of claim 1, wherein:

the first front supporting member is bigger in size than the second front supporting member.

10. The gaming device of claim 1 further comprising:

a support stand having a base and a stand extending perpendicularly from the base, wherein the stand is coupled to the gear turntable member along at least one position.

11. The gaming device of claim 10, wherein the stand is coupled to the gear turntable member along at least one position by at least one coupler.

12. The gaming device of claim 11, wherein the at least one coupler comprises: a screw and a butterfly button.

13. The gaming device of claim 1, wherein the first gear wheel and the second gear wheel comprise colour codes.

14. The gaming device of claim 13, wherein the first gear wheel comprises different colour codes on alternating tooth of the plurality of teeth.

15. The gaming device of claim 14, wherein the second gear wheel comprises same colour codes on each tooth of the plurality of teeth.

16. A method of playing game using a gaming device having:

a geared-wheel assembly having a first gear wheel and a second gear wheel rotatably engaged with each other, wherein the first gear wheel is rotatable along a first axis of rotation and a second gear wheel is rotatable along a second axis of rotation, the first gear wheel having a first plurality of teeth and a first plurality of slots, wherein each tooth and slot of the respective first plurality of teeth and first plurality of slots are alternatively aligned across a circumferential edge of the first gear wheel, each alternate tooth of the first plurality of teeth having a first card pin coupled to the tooth, the second gear wheel having a second plurality of teeth and a second plurality of slots, wherein each tooth and slot of the respective second plurality of teeth and second plurality of slots are alternatively aligned across a circumferential edge of the second gear wheel, each alternate tooth of the second plurality of teeth having a second card pin coupled to the tooth, a gear turntable member aligned behind the first gear wheel and the second gear wheel to rotatingly couple the first gear wheel and the second gear wheel along the respective first axis of rotation and second axis of rotation;

a first coupling arrangement to rotatingly couples the first gear wheel with the gear turntable member along the first axis of rotation in spaced manner from each other;

a second coupling arrangement to rotatingly couple the second gear wheel with the gear turntable member along the second axis of rotation in spaced manner from each other;

a first front supporting member placed in front and coupled to the first gear wheel along the first axis of rotation; and a second front supporting member placed in front and coupled to the second gear wheel along the second axis of rotation, the method comprising:

rotating at least one of the first gear wheel and the second gear wheel, respectively, via the first coupling arrangement and the second coupling arrangement, along the respective first axis of rotation and second axis of rotation;

defining a winning position, when the first card pin and the second card pin of the respective tooth of the first and second plurality of teeth are aligned adjacent to each other, or defining a losing position, when the first card pin and the second card pin of the respective tooth of the first and second plurality of teeth are not aligned adjacent to each other.

17. The method of claim 16, wherein in one game played, the game device selects only one position, either the winning position or the losing position.

18. The method of claim 16, wherein in one game played, one or more player plays the game for, either the winning position or the losing position.

* * * * *